US007360879B2

(12) United States Patent
Castle et al.

(10) Patent No.: US 7,360,879 B2
(45) Date of Patent: Apr. 22, 2008

(54) INKJET PEN ADAPTER

(76) Inventors: Steven T. Castle, 811 Pioneer St., Philomath, OR (US) 97370; Jefferson P. Ward, 17903 NE. Homestead Dr., Brush Prairie, WA (US) 98606; Phillip R. Hays, 919 NW. 34th St., Corvallis, OR (US) 97330; Eric L. Ahlvin, 3875 NW. Wisteria Way, Corvallis, OR (US) 97330

( * ) Notice: Subject to any disclaimer, the term of this patent is extended or adjusted under 35 U.S.C. 154(b) by 268 days.

(21) Appl. No.: 10/901,806

(22) Filed: Jul. 29, 2004

(65) Prior Publication Data

US 2006/0023040 A1 Feb. 2, 2006

(51) Int. Cl.
*B41J 2/175* (2006.01)

(52) U.S. Cl. ..... 347/86; 347/85

(58) Field of Classification Search ..... 347/85–86, 347/87

See application file for complete search history.

(56) References Cited

U.S. PATENT DOCUMENTS

| | | | | |
|---|---|---|---|---|
| 5,208,610 | A * | 5/1993 | Su et al. | 347/49 |
| 5,512,926 | A | 4/1996 | Uchikata et al. | |
| 5,663,753 | A | 9/1997 | Story et al. | |
| 5,764,260 | A * | 6/1998 | Vu et al. | 347/87 |
| 6,155,678 | A * | 12/2000 | Komplin et al. | 347/86 |
| 6,161,920 | A * | 12/2000 | Santhanam et al. | 347/50 |
| 6,193,363 | B1 * | 2/2001 | Kelly | 347/86 |
| 2002/0163566 | A1 * | 11/2002 | Jang et al. | 347/86 |
| 2004/0162041 | A1 * | 8/2004 | Ferguson | 455/127.2 |

* cited by examiner

*Primary Examiner*—Julian D. Huffman
*Assistant Examiner*—Jason Uhlenhake

(57) ABSTRACT

A pen adapter is configured, in one example, to include a body having an internal surface defining a set of negative datum features configured to interlock with a first set of positive datum features. An external surface of the pen adapter is configured to define a second set of positive datum features.

19 Claims, 5 Drawing Sheets

INKJET PEN ADAPTER

BACKGROUND

It is commonly the case that an inkjet printer is configured to operate with a replaceable "pen." Inkjet pens are generally configured as disposable cartridges, and may be referred to by users as "printheads," "replacement cartridges," "ink cartridge" or similar names. Pens are configured to allow easy user-performed replacement and disposal of the old pen and installation and use of the new pen. Significantly, the user is spared any contact with ink, and the entire replacement operation typically involves little more than unplugging the old pen and plugging in the new pen. Such pens contain a printhead orifice plate defining hundreds of "ink-jets" through which ink is ejected in a precise manner during operation, an electrical interconnect surface through which communication with the printer is established and a reservoir of ink.

Perhaps as a result of the success of inkjet printers, a large number of inkjet "pens" exist. Such pens differ in size, shape, quantity of ink contained, configuration of the electrical interconnect, number and configuration of nozzle jets defined in the nozzle orifice plate and other ways. In fact, the number, variations and distinctions between the pens available can be almost bewildering to consumers as they look for a pen to fit a particular make and model of printer.

Notwithstanding the diversity of available pens, it is typically the case that any given printer is configured to use only one pen, although it is occasionally possible to purchase the available pen partially full of ink for a reduced price. Any other pen probably will not fit, will not work and may cause damage to the printer. Thus, while a large number of pens are generally available—many having desirable features (e.g. large ink reservoirs or low cost)—only a narrow fraction of those available may be used with any given printer. Accordingly, an apparatus which tended to reverse the trends seen above—and which gave the consumer a greater choice from among existing pens—would be well-received.

SUMMARY

A pen adapter is configured, in one example, to include a body having an internal surface defining a set of negative datum features configured to interlock with a first set of positive datum features. An external surface of the pen adapter is configured to define a second set of positive datum features.

BRIEF DESCRIPTION OF THE DRAWINGS

The following detailed description refers to the accompanying figures. In the figures, the left-most digit(s) of a reference number identifies the figure (Fig.) in which the reference number first appears. Moreover, the same reference numbers are used throughout the drawings to reference like features and components.

DETAILED DESCRIPTION

The following discussion is directed to a pen adapter for use with a printer. The pen adapter allows an inkjet printer, initially configured for use with a larger pen, to use a smaller pen. A "pen," in the context of an inkjet printer, is a removable device sometimes commercially known as a "printhead cartridge" or similar. The pen typically contains a nozzle orifice plate from which ink is ejected; an electrical interface to connect to the inkjet printer; and a reservoir of ink. The pen may be designed for manual removal upon failure or upon exhaustion of the ink reservoir, and for replacement with a new pen by an unskilled user.

One example of the pen adapter includes a body having an internal surface configured to define a set of negative datum features to interlock with a set of positive datum features defined by the external surface of the smaller pen. Datum features include protuberances and recesses on a surface, as well as distances between surfaces.

Similarly, the external surface of the pen adapter is configured to define a second set of positive datum features, thereby replicating the datum features of the large pen. Accordingly, the small pen fits into the pen adapter, and the pen adapter fits into the inkjet printer which was designed for use with the large pen. In one implementation of the pen adapter, both of the set of negative datum features and the second set of positive datum features include at least one datum feature preventing movement of the small pen and the pen adapter, relative to a printer within which the pen adapter and the small pen are installed, in each of the X, Y and Z directions.

Figure 1:
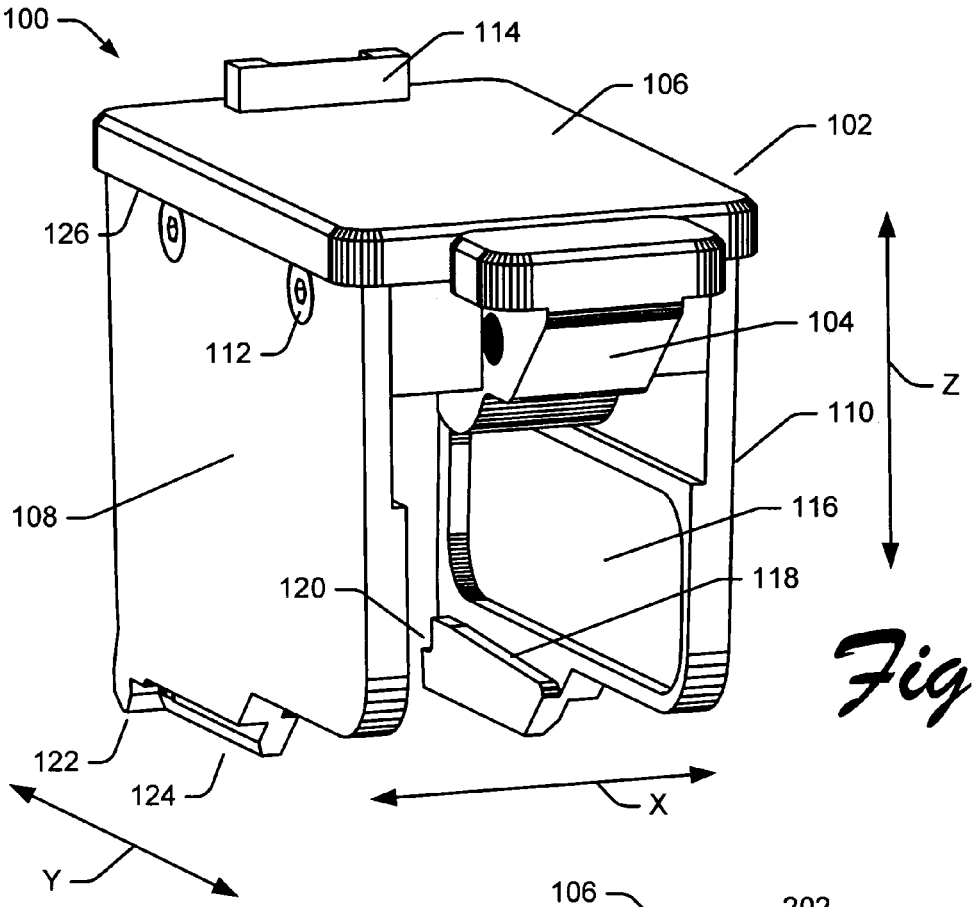
FIG. 1 is an isometric view of the top, left side and down-stream (according to paper flow through the printer) sides of an exemplary version an inkjet pen adapter.

FIG. 1 is an isometric view of an exemplary version a pen adapter 100, having a body 102 and latch 104. In the example of FIG. 1, the body 102 includes a top 106, a left side 108, an open down-stream (according to paper flow through the printer) side, and a right side 110. In the view of FIG. 1, an outside surface of the left side is visible, while an inside surface of the right side 110 is visible. The left and right sides 108, 110 (which are typically mirror images) are connected to the top 106 by fasteners, such as bolts 112. In the example of FIG. 1, the top 106 supports a latching feature 114, which allows the printer to grasp the pen adapter 100, and to hold it securely.

The inside surface of the right side 110 defines a recessed area 116 which, along with other factors such as material selection, thickness, dimensioning, etc., allows the weight of the pen adapter 100 to be controlled. In general, the weight of the pen adapter 100 and the small pen 400 (first seen in FIG. 4) should be approximately the same as the weight of the large pen which is replaced by the combined pen adapter 100 and small pen 400.

The inside surface 110 of the right side also illustrates a rail 118 upon which the small pen can slide as it is inserted into the pen adapter 100. A datum feature 120 is part of a set of negative datum features into which positive datum features of the small pen 400 (FIG. 4) fit. Additional datum features within the set of negative datum features include the width between inside surfaces of the left side 108 and right side 110, the distance between the rails 118 and latch 104, etc.

A second set of positive datum features are formed by the external surface of the body 102 of the pen adapter 100. The second set of positive datum features are configured to be the same as, or similar to, the outside surface of the large pen. For example, the distance between the outside surfaces of the left and right sides 108, 110 is a datum feature, as well as size, shape and orientation of a toe 122 and rail 124. A shoulder 126 may be present where the top 106 is joined to the left and right sides 108, 110.

Figure 2:
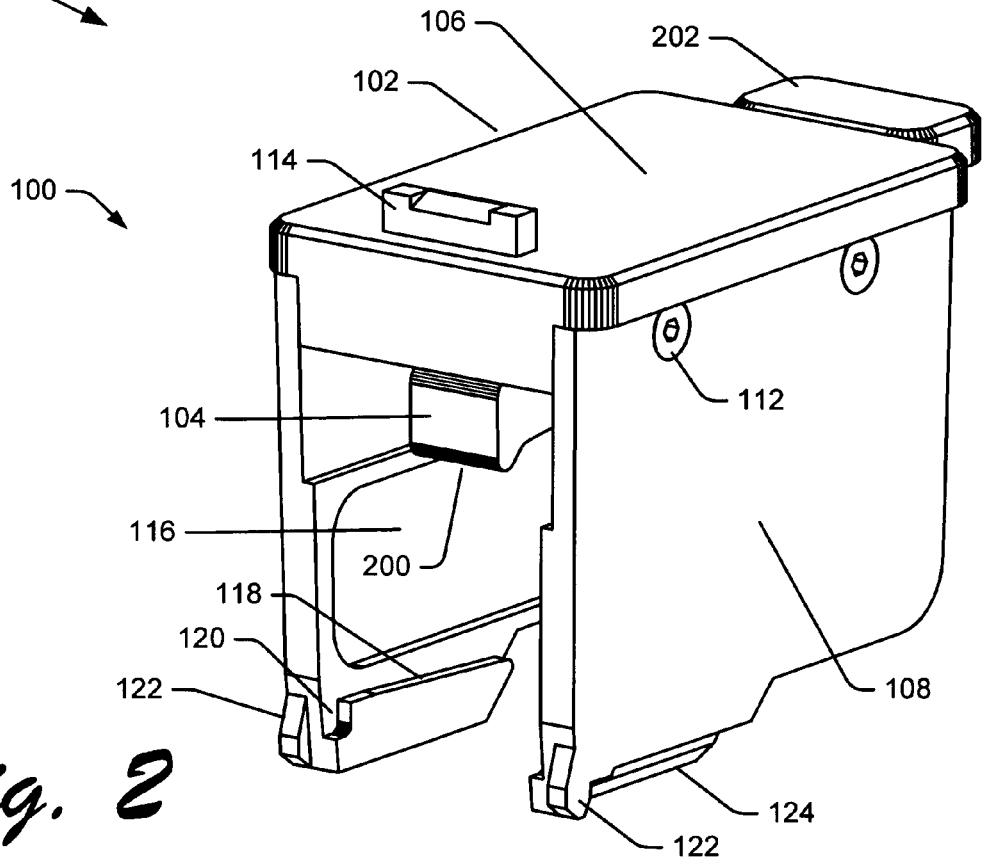
FIG. 2 is an isometric view of the top, left side and up-stream sides of the exemplary pen adapter of FIG. 1.

FIG. 2 is a second isometric view of the pen adapter 100 seen earlier in FIG. 1, showing a different view of the body 102 and latch 104. In this view, the top 106, left side 108 and an open up-stream side are seen. The view of the latch 104 from this perspective reveals a moveable latching element 200, which is defined by a portion of the latch 104. When the small pen is installed within the pen adapter, the moveable latching element 200 contacts the small pen with a biasing force. The biasing force seats the positive datum features of the small pen on the negative datum features defined on the inside surface of the pen adapter 100. Accordingly, the correct relative position of the two is maintained. In the example of FIG. 2, the moveable latching element 200 moves substantially up and down in response to movement of the finger pad 202. Such movement toggles the pen adapter between an engaged state and a released state. The engaged state holds the small pen in position for printer operation. The released state allows the small pen to be installed or removed from the pen adapter 100. In the engaged state, the electrical interface 606 and print head orifice plate 608 (see FIG. 6) align correctly with corresponding features in the printer. Typically, the engaged state results in alignment between the small pen and the printer such that the electrical interface and print head orifice plate of the small pen is located where the corresponding parts of the large pen would be located. Thus, as will be better understood by reference to detail within FIG. 4, in the engaged state the moveable latching element 200 is down and a small pen is secured within the pen adapter 100. In contrast, when the moveable latching element 200 is up, a small pen may be removed or installed within the pen adapter 100.

Figure 3:
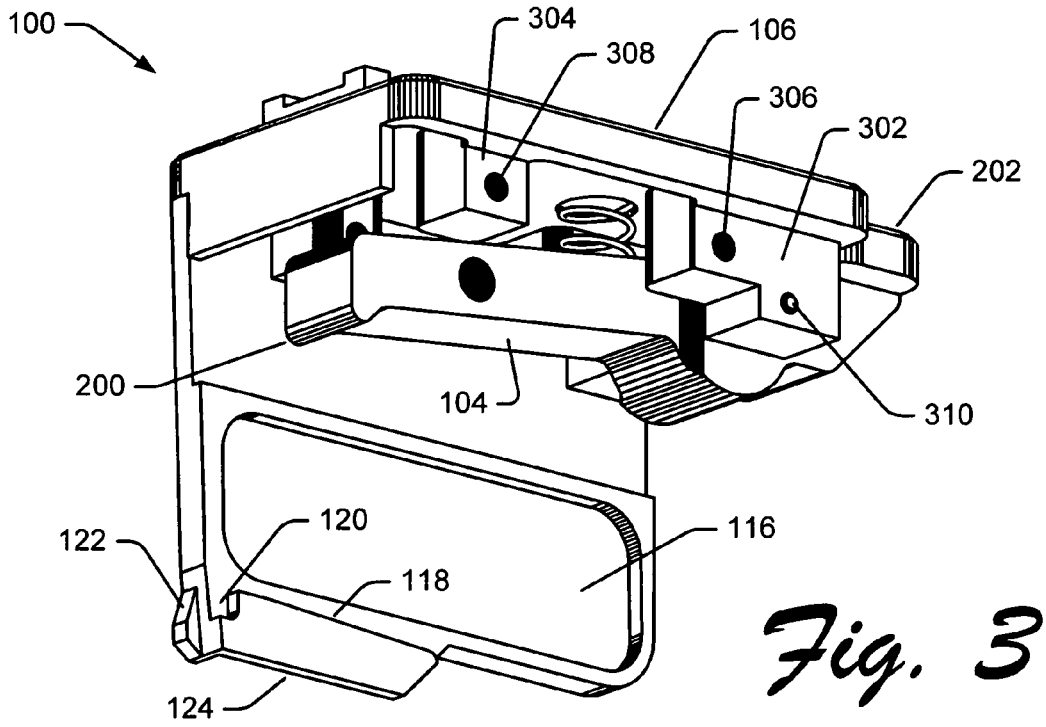
FIG. 3 is an isometric view of the lower surface of the exemplary pen adapter of FIG. 1, wherein the left side has been removed to reveal interior components.

FIG. 3 is an isometric view of the lower surface of the exemplary pen adapter 100 of FIG. 1, wherein the left side has been removed to reveal interior components. In particular, FIG. 3 illustrates an example of a structure for use in securing the sides to the top 106. Blocks 302, 304 define threaded holes 306, 308, respectively, for use in attaching the left side (removed to show detail) using bolts 112 (seen in FIGS. 1 and 2). Mirror image structures may be used to attach the right side 110 to the top 106.

Additional detail of the latch 104 is seen in FIG. 3. A pivoting axle 310 (supported by block 302) allows the latch 104 to be pivoted manually by operation of the finger pad 202 between an engaged state (seen in FIG. 4) and a released state. In the engaged state, the small pen is secured within the pen adapter 100, in part by the moveable latching element 200 which engages the small pen. In the released state the moveable latching element 200 is no longer engaged to the small pen, which is easily removed from the pen adapter 100 by manual manipulation.

Figure 4:
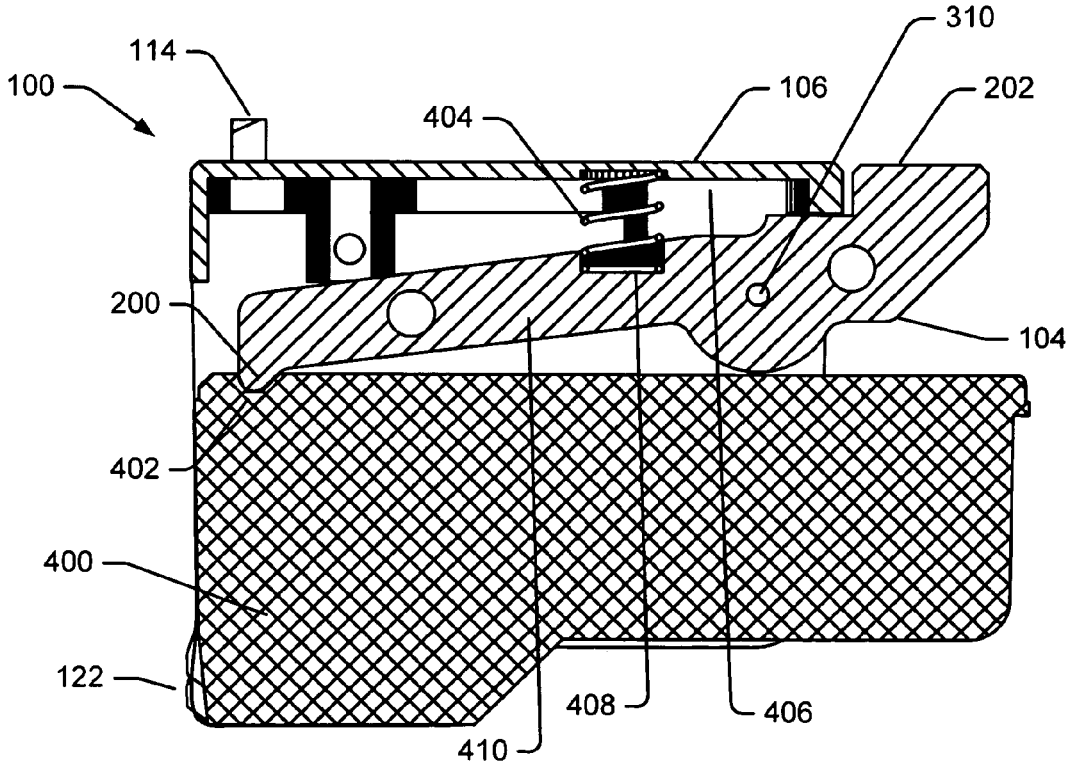
FIG. 4 is an orthographic cross-sectional view of the pen adapter of FIG. 1, additionally showing a small pen contained within the pen adapter.

FIG. 4 is a cross-sectional view of the pen adapter 100 of FIG. 1, additionally showing a small pen 400 contained within the pen adapter. In particular, the moveable latching element 200 is shown in the engaged state, wherein the moveable latching element is engaged with the surface of the small pen.

A fastening or biasing mechanism—in the example of FIGS. 3 and 4 represented by spring 404—biases the latching mechanism 104 into the engaged state, wherein the small pen 400 is secured within the pen adapter 100. The spring 404 is supported between the internal surface 406 of the top piece 106 and a recess 408 defined in the elongated body 410 of the latching mechanism 104. Thus, in its relaxed state, the spring 404 biases the latching mechanism into the engaged state, wherein the moveable latching element 200 engages the small pen 400. When the spring 404 is compressed by manual pressure on the finger pad 202, the moveable latching element 200 is no longer engaged with the small pen 400. As a result, the small pen 400 may be manually removed by a user. In the design of FIGS. 1-4, the small pen 400 can be installed or removed by manual pressure on the finger pad 202 without regard to whether the pen adapter 100 is installed or not installed in a printer. When installed, the pen adapter 100 is configured to locate the printhead (i.e. nozzle orifice plate) and electrical contacts of the small pen in the exact location wherein the large pen would position the same elements.

Figure 5:
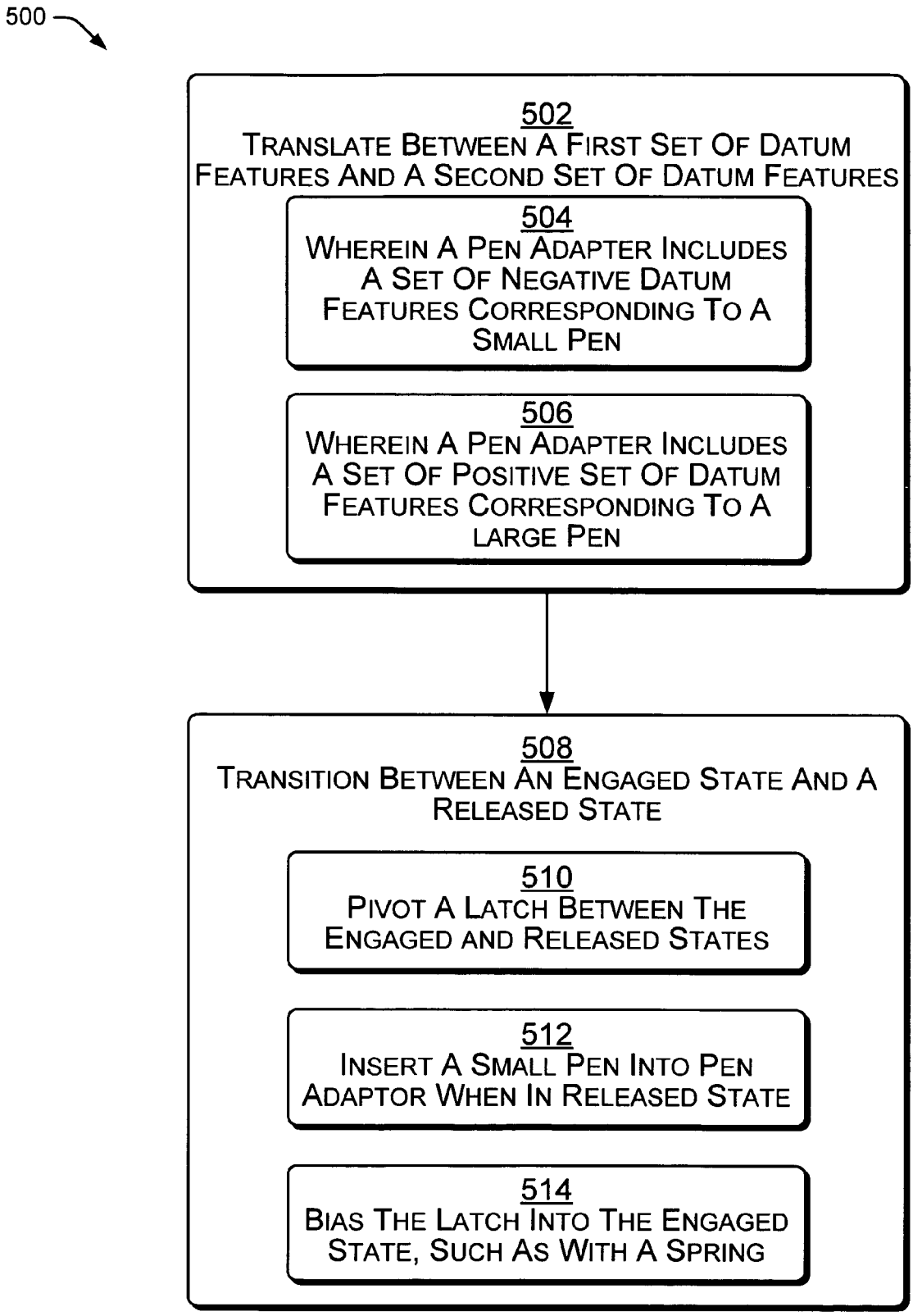
FIG. 5 is a flow diagram that describes a method employed for use in adapting a printer, initially configured to operate with a larger pen, to subsequently operate with a smaller pen.

FIG. 5 is a flow diagram that describes an example 500 of a method employed for use in adapting a printer, initially configured to operate with a larger pen, to subsequently operate with a smaller pen. The elements of the method may be performed by any desired means, such as by manual operation of components seen in FIGS. 1-4 or such as by the automated movement of mechanical parts initiated and controlled through the execution of processor-readable instructions defined on a processor-readable media, such as a disk, a ROM or other memory device. As used herein, the phrase computer- or processor-readable media or medium can refer to any medium that can contain, store or propagate computer executable instructions. Thus, in this document, the phrase computer- or processor readable medium may refer to a medium such as an optical storage device (e.g., a CD ROM), a solid state memory device such as RAM or ROM, a magnetic storage device (e.g., a magnetic tape), or memory or media or other technology. The phrase computer- or processor-readable medium or media may also refer to signals that are used to propagate the computer executable instructions over a network or a network system, such as an intranet, the World Wide Web, the Internet or similar network. Also, actions described in any block may be performed in parallel with actions described in other blocks, may occur in an alternate order, or may be distributed in a manner which associates actions with more than one other block.

At block 502, a translation is made between a first set of positive datum features and a second set of positive datum features. Such a translation allows operation of a printer—originally designed for use with a large pen—with a small pen. One example of the translation utilizes the pen adapter 100 seen in FIGS. 1-4. According to a translation using the pen adapter 100 of FIGS. 1-4, at block 504 an interior of the pen adapter defines the first set of negative datum features sized and configured to engage the positive datum features of a small pen 400 At block 506 the outside surface of the pen adapter 100 defines a second set of positive datum features corresponding to a large pen, originally intended for use with the printer.

At block 508, a transition is made between an engaged state and a released state. At block 510, a latch 104 is pivoted between engaged and released states. The pivoting may be performed manually, such as by operation of a finger pad. At block 512, the small pen may be inserted into, or removed from, the pen adapter when the latch 104 is released, such as by manual operation of a finger pad 202. At block 514, the latch 104 is biased into the engaged state, such as by a spring. The latch may include a latching element 200, which biases the positive datum features of a small pen into the negative datum features defined on the interior surface of the pen adapter 100 during the engaged state.

Figure 6:
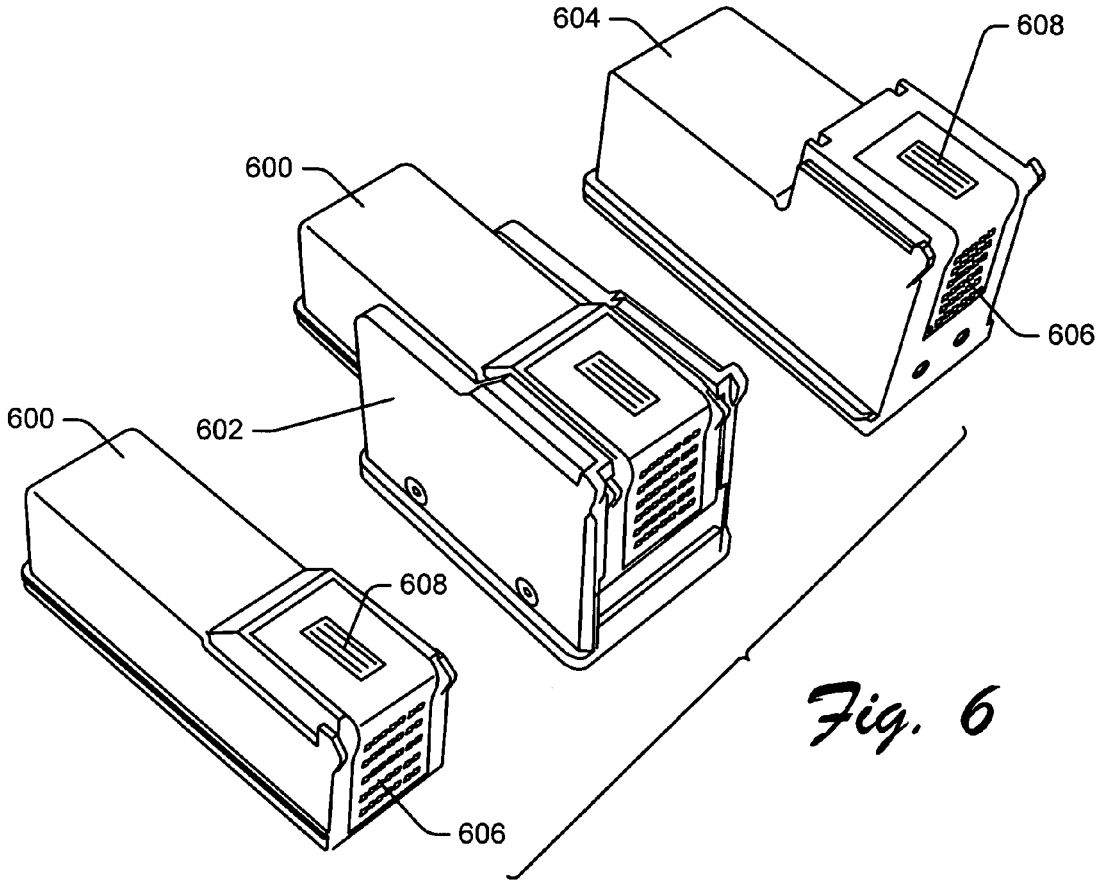
FIG. 6 is an isometric view of a small pen, a small pen installed within a second example of an inkjet pen adapter, and a large pen.

FIG. 6 is an isometric view of a small pen 600, a small pen installed within an example of an adapter 602, and a large pen 604. Comparison of the small pen 600 installed in the adapter 602 and the large pen 604 reveals that the external surface of each defines a number of similar positive datum features. Accordingly, either the small pen 600 when installed in the adapter 602 or the large pen 604 could be installed in the same printer. Either installation would correctly align the electrical contact points 606 and nozzle orifice plate 608.

Figure 7:
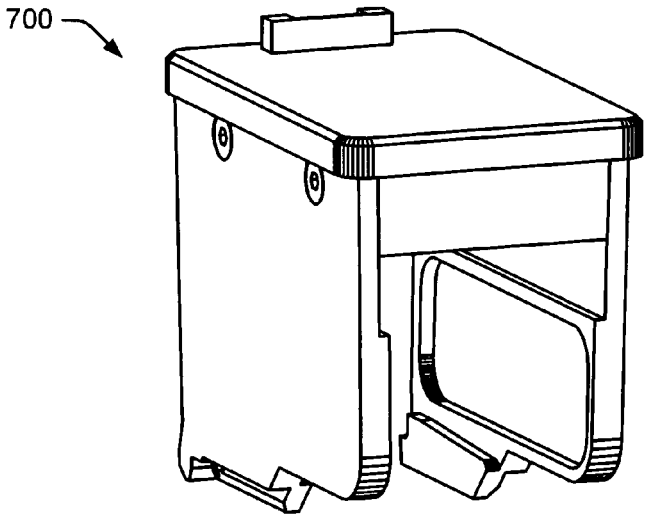
FIG. 7 is an isometric view of the top, left side and down-stream (according to paper flow through the printer) sides of a third exemplary embodiment an inkjet pen adapter.
Figure 8:
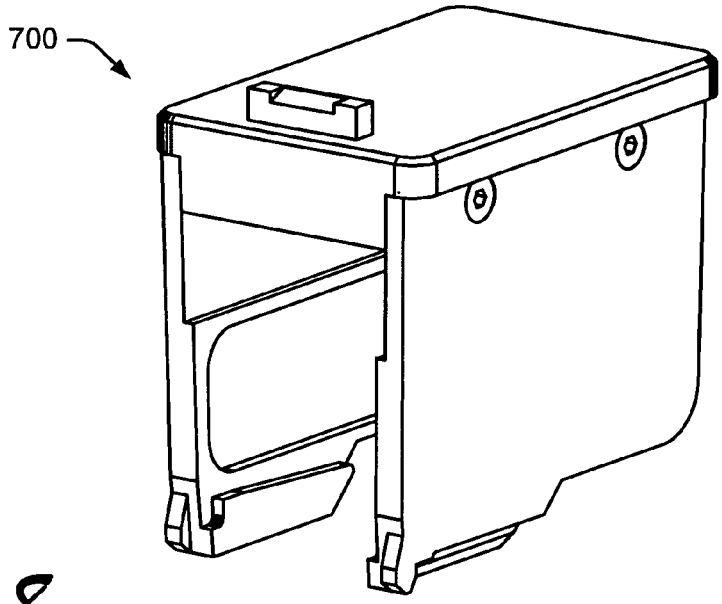
FIG. 8 is an isometric view of the top, left side and up-stream sides of the exemplary inkjet pen adapter of FIG. 7.

FIG. 7 is an isometric view of the top, left side and down-stream (according to paper flow through the printer) sides of a second exemplary version an inkjet pen adapter 700. In one example, adapter 700 is configured of a resiliently deformable plastic material, wherein the resilience serves as a latching mechanism by flexing slightly to allow the small pen to snap into place. FIG. 8 is an isometric view of the top, left side and up-stream sides of the exemplary pen adapter 700 of FIG. 7.

Figure 9:
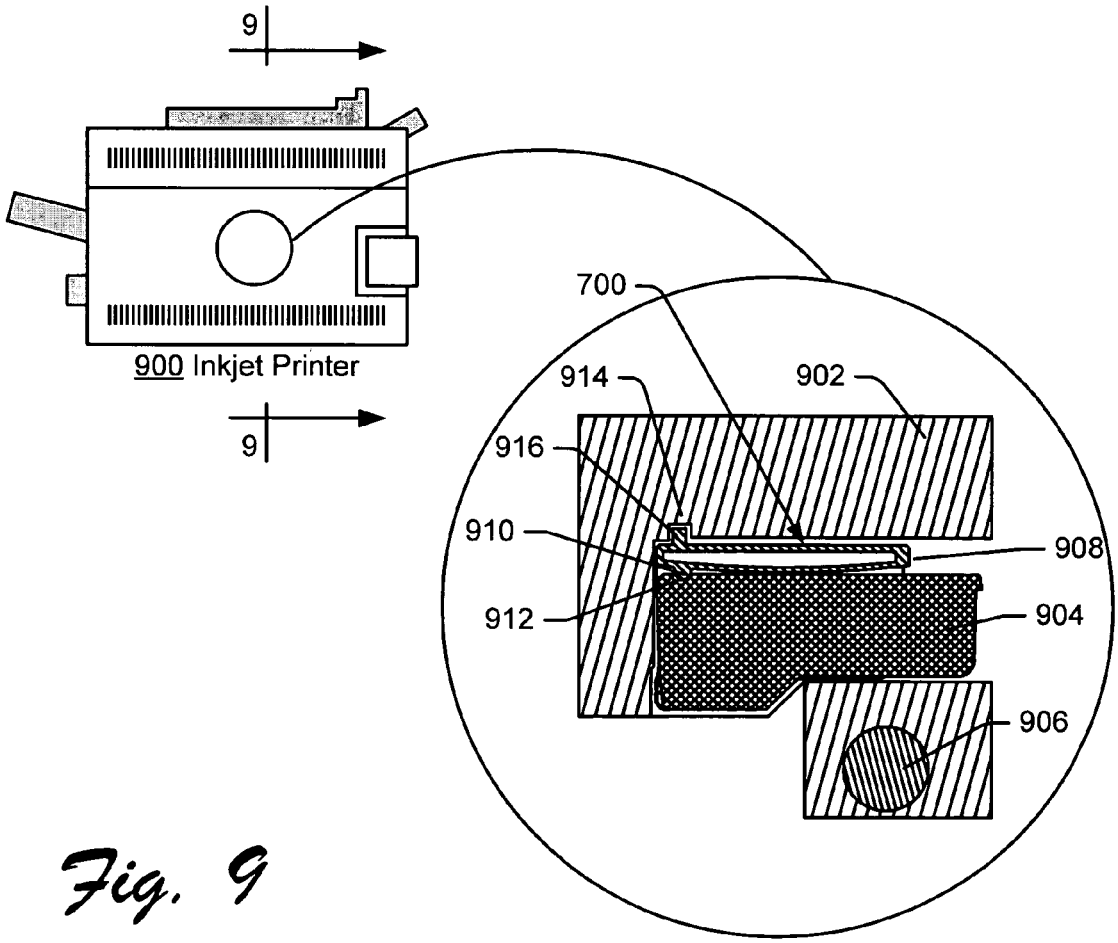
FIG. 9 is an example of a printer having an inkjet pen adapter installed, wherein a cross-sectional view having enlarged detail of the adapter and portions of the printer is shown according to the arrows labeled 9-9.

FIG. 9 is an example of a printer 900 having the adapter 700 installed. In particular, an area of enlarged detail shows the adapter 700 according to a cross-section indicated by arrows labeled 9-9. A receiver portion 902 of the printer 900 allows the adapter 700 containing a small pen 904 to be installed within the printer. The receiver portion 902 is typically configured for transverse motion, carried by a carriage rod 906. In the example illustrated, a resiliently deformable latching mechanism 908 flexes slightly upon installation and removal of the small pen 904, allowing the small pen to snap into place. In particular, a negative datum feature 910 defined on the latching mechanism 908 snaps into a positive datum feature 912 defined on the small pen 904. Similarly, the receiver portion 902 or bay of the printer 900 is configured with a negative datum feature 914 to engage one or more positive datum features 916 defined by an external surface of the body of the adapter 700. Note that the structures which secure the receiver portion 902 of the printer 900 to the adapter 700, and which secure the adapter 700 to the small pen 904 are shown for purposes of example only, and that alternative structures could alternatively be utilized.

Although the above disclosure has been described in language specific to structural features and/or methodological steps, it is to be understood that the appended claims are not limited to the specific features or steps described. Rather, the specific features and steps are exemplary forms of implementing this disclosure. For example, while higher performance may be achieved when the pen adapter 100 is made of metal, molded plastic could be substituted to reduce cost. Similarly, while examples of a latching mechanism have been illustrated, other examples would be consistent with the teachings expressed herein. Additionally, while datum features have been expressed as "positive" and "negative," these terms could be reversed or replaced. Moreover, while the adapter has been described as attaching to the small pen or the printer, the small pen and/or printer could alternatively be configured to attach to the adapter. And still further, while references have been made to "upstream" and "downstream", in certain applications these references may be reversed, or viewed from a different perspective.

The invention claimed is:

1. A pen adapter, comprising:

a body having a pair of internal surfaces disposed opposite one another, the internal surfaces configured to define a set of negative datum features corresponding to a first set of positive datum features, the first set of positive datum features corresponding to a first pen;

a latching mechanism, carried by the body between the internal surfaces, movable between an engaged state in which a pen inserted in the adapter is secured in the adapter and a released state in which a pen inserted in the adapter may be removed from the adapter; and an external surface, of the body, configured to define a second set of positive datum features, the second set of positive datum features corresponding to a second pen;

wherein the pen adapter is configured to adapt a pen, originally for use with a printer requiring the first pen, for use with a printer requiring the second pen.

2. The pen adapter of claim 1, wherein the first pen is smaller than the second pen.

3. The pen adapter of claim 2, wherein the set of negative datum features together with the first set of positive datum features prevent movement between the first pen and the pen adapter, respectively.

4. The pen adapter of claim 1, wherein the latching mechanism comprises:

an elongated body supported by a pivot attached to the body;

a finger pad to allow manual movement of the elongated body about the pivot between the engaged and the released states; and a spring, supported between the body and the latching mechanism and configured to bias the latching mechanism into the engaged state.

5. The pen adapter of claim 1, wherein the pen adapter, while in the engaged state, is configured to adapt a printer, initially configured to operate with a large pen, to subsequently operate with a small pen.

6. The pen adapter of claim 1, wherein the latching mechanism is configured to immobilize a pen within the pen adapter.

7. The pen adapter of claim 1, wherein:

the latching mechanism is configured to bias a pen against the set of negative datum features; and movement of the latching mechanism alternates the pen adapter between the engaged state and the released state.

8. The pen adapter of claim 1, wherein the body comprises:

a center plate; and left and right side plates each having one of the internal surfaces thereon, extending from left and right edges of the center plate.

9. The pen adapter of claim 1, further comprising a rail along each of the internal surfaces of the body upon which a pen slides as it is inserted into and removed from the adapter.

10. The pen adapter of claim 9, further comprising a recessed area in the body along each internal surfaces adjacent to the rail.

11. The pen adapter of claim 9, wherein the rail comprises one of the negative datum features.

12. A pen adapter, comprising:

means for translating between a first set of datum features and a second set of datum features, the means for translating comprising a body having an internal surface defining a set of negative datum features corresponding to positive datum features defined by an external surface of a first pen, the body additionally comprising an external surface defining a second set of datum features corresponding to external datum features of a second pen and wherein the means for transitioning includes a latch having means for supporting the latch to allow pivoting movement between the engaged state and the released state and means for biasing the latch into the engaged state; and means for transitioning between an engaged state and a released state, wherein during the released state entrance to, and exit from, the means for translating is possible.

13. The pen adapter of claim 12, wherein the first set of datum features comprises datum features corresponding to a small pen.

14. The pen adapter of claim 12, wherein the second set of datum features comprises datum features corresponding to a large pen.

15. The pen adapter of claim 12, wherein the means for translating comprises a body having an inner surface configured according to a negative of the first set of datum features and an outer surface configured according to the second set of datum features.

16. The pen adapter of claim 12, wherein:

the means for biasing the latch comprises a spring; and compression of the spring results in the released state and decompression of the spring results in the engaged state.

17. A method of adapting a printer, initially configured to operate with a larger pen, to subsequently operate with a smaller pen, comprising:

installing the smaller pen in a pen adapter, wherein the pen adapter translates between a first set of datum features and a second set of datum features, the first set of datum features corresponding to the smaller pen and the second set of datum features corresponding to the larger pen, wherein the pen adapter is configured to adapt a pen, originally for use with a printer requiring the smaller pen, for use with a printer requiring the larger pen;

transitioning the pen adapter between an engaged state and a released state, wherein in the engaged state the smaller pen is immobilized with respect to the second set of datum features and wherein transitioning includes pivoting a latch between the engaged state and the released state, wherein the latch is biased into the engaged state; and installing the pen adapter in the printer.

18. The method of claim 17, wherein the translating between a first set of datum features and a second set of datum features comprises:

interfacing an inner surface, configured according to a negative of the first set of datum features, to the smaller pen; and interfacing an outer surface, configured according to the second set of datum features, to the printer configured for use with the larger pen.

19. The method of claim 17, wherein pivoting the latch comprises manually depressing a finger pad.

* * * * *